US008006980B1

(12) United States Patent
Herro et al.

(10) Patent No.: US 8,006,980 B1
(45) Date of Patent: Aug. 30, 2011

(54) BEER PONG TABLE WITH COOLING SYSTEM

(75) Inventors: Philip Dana Herro, Warren, NJ (US); Barry James Jensen, Windham, NH (US)

(73) Assignee: Big Dogg Pong LLC, Warren, NJ (US)

( * ) Notice: Subject to any disclaimer, the term of this patent is extended or adjusted under 35 U.S.C. 154(b) by 71 days.

(21) Appl. No.: 12/427,391

(22) Filed: Apr. 21, 2009

Related U.S. Application Data

(60) Provisional application No. 61/046,567, filed on Apr. 21, 2008.

(51) Int. Cl.
*A63B 67/00* (2006.01)
*A63B 63/00* (2006.01)
*A63F 7/00* (2006.01)

(52) U.S. Cl. ..... 273/342; 473/496

(58) Field of Classification Search ..... 273/309, 273/342, 400–402; 473/496; 108/25; 62/457.1, 62/457.3, 530, 371, 458, 258, 261
See application file for complete search history.

(56) References Cited

U.S. PATENT DOCUMENTS 3,364,882 A * 1/1968 Merrick ..... 108/25
3,922,879 A * 12/1975 Arnold ..... 62/458
4,762,327 A * 8/1988 Gomez ..... 273/309
5,415,010 A * 5/1995 Woo ..... 62/258
6,067,813 A * 5/2000 Smith ..... 62/371
7,004,465 B2 * 2/2006 Keith ..... 273/108
7,325,807 B1 2/2008 Eason
7,516,960 B1 * 4/2009 Battiste ..... 273/342
2003/0150238 A1 * 8/2003 Dais et al. ..... 62/457.6
2003/0230110 A1 * 12/2003 Linberg et al. ..... 62/457.1
2004/0188942 A1 * 9/2004 Trokan ..... 273/342
2005/0029747 A1 2/2005 Grayson
2006/0065665 A1 3/2006 Swartfager et al.
2006/0226606 A1 10/2006 Finley et al.
2007/0107460 A1 5/2007 Webb et al.

OTHER PUBLICATIONS

Banjo, Shelly, "Thwock, Gulp, Kaching! Beer Pong Inspires Inventors", The Wall Street Journal, Aug. 29, 2007, printed from http://online.wsj.com/article/SB118834341517511527.html.

* cited by examiner

*Primary Examiner* — Raleigh W. Chiu
(74) *Attorney, Agent, or Firm* — Hoffmann & Baron, LLP

(57) ABSTRACT

A beer pong table is provided herein which, includes an elongated, planar member having a top surface. A hole extends through the top surface and at least partially through the planar member so as to define a first recess in the planar member, with a cooling arrangement being disposed in the first recess. Advantageously, with the subject invention, a beer pong table may be provided with a recessed cooling arrangement. The recessed arrangement provides flexibility in cup arrangement during play and facilitates cleaning.

19 Claims, 17 Drawing Sheets

BEER PONG TABLE WITH COOLING SYSTEM

CROSS-REFERENCE TO RELATED APPLICATION

This application claims priority to U.S. Provisional Patent Application No. 61/046,567, filed Apr. 21, 2008, the entire contents of which are hereby incorporated by reference.

FIELD OF THE INVENTION

The present invention relates to a beer pong table. In particular, the present invention relates to a beer pong table that includes a cooling system.

BACKGROUND

Beer pong is a widely popular drinking game that utilizes a planar surface, cups at least partially filled with a beverage, and ping pong balls. Players on each side of the planar surface attempt to throw the ping pong balls into one of the cups at the opposite side of the table. If the player succeeds, his or her opponent must drink the beverage that is in the cup.

Typically, the game includes two teams of players and is played on a free-standing table approximately measuring 8 feet by 2 feet. Each team has a group of cups set up in a triangular pattern on each side of the table, typically beginning with 10 cups (in a 4-3-2-1 pattern) or 6 cups (in a 3-2-1 pattern). Each cup is at least partially filled with a beverage, and the beverage is typically alcoholic, most typically, beer. Although rules for the game may vary, the overall purpose of beer pong is for each team to eliminate the other team's cups by throwing or bouncing ping pong balls into the other team's cups.

The rules for each beer pong game may vary. Depending upon the particular set of rules adopted, the defending side may defend its cups. In one variation, no defense is permitted, yet in other variants, the defending side may use hands, one's breath, a paddle or the like. If a ball comes to rest in a defending side's cup, the defending side must drink the contents thereof and the cup is removed from the playing field. When two balls are used and the offensive side is successful in landing both in the cups, the defensive side may be required to remove an additional cup from play and drink its contents, or the game may be considered over. As cups are removed from play, some rule variations allow (or require) re-arrangement of the remaining cups. The side to remove all of the opponent's cups from the playing surface is the winner. Typically, the rules require that the losing team consume the contents of any cups remaining on the winning side's end of the playing surface. In tournament play, rules typically follow the "WORLD SERIES OF BEER PONG"™ Full Rules and Regulations.

The preferred playing field for this game is from about six to about eight feet long, with a width in the range of from about two to about three feet. The cups are typically arranged within 18 inches from an end of the playing field, but usually no closer than about 1-4 inches from an end. The preferred playing field is similar in shape and size to that of the surface of a closet door. The playing field is usually placed in a flat horizontal position at the approximate height of a conventional table.

Beer pong is commonly played on a variety of improvised playing fields, including kitchen tables, closet doors, homemade tables, and random pieces of scrap wood, all of which are generally inadequate. This can unfairly affect the difficulty of the game. To promote fairness, it is important that cups are placed in the same starting and regrouping positions on each end of the playing surface, and that this placement is consistent from game to game.

In the prior art, the beverages may become warm during play and, thus, less enjoyable to drink. The length or difficulty of the game may lead to the beverage being warmed up, as well as, environmental conditions (e.g. playing in a warmer environment).

U.S. Patent Publication No. 2007/0107460 describes a freezer pack usable for chilling multiple cups. This freezer pack may be used with a beer pong table to provide limited cooling during play. The freezer pack, however, is formed with cup holders. This limits the ability to move or re-arrange cups during play. Also, the freezer pack lays atop the beer pong table during use.

SUMMARY

A beer pong table is provided herein which includes an elongated, planar member having a top surface. A hole extends through the top surface and at least partially through the planar member so as to define a first recess in the planar member, with a cooling arrangement being disposed in the first recess. Advantageously, with the subject invention, a beer pong table may be provided with a recessed cooling arrangement. The recessed arrangement provides flexibility in cup arrangement during play and facilitates cleaning.

As used herein the term "beer pong" may include any drinking game associated with utilizing a planar surface and a plurality of cups, including but not limited to beer pong, beiruit, ruit, lob pong, flip cup, quarters and the like and combinations thereof.

These and other features of the invention will be better understood through a study of the following detailed description and accompanying drawings.

DETAILED DESCRIPTION

Figure 1:
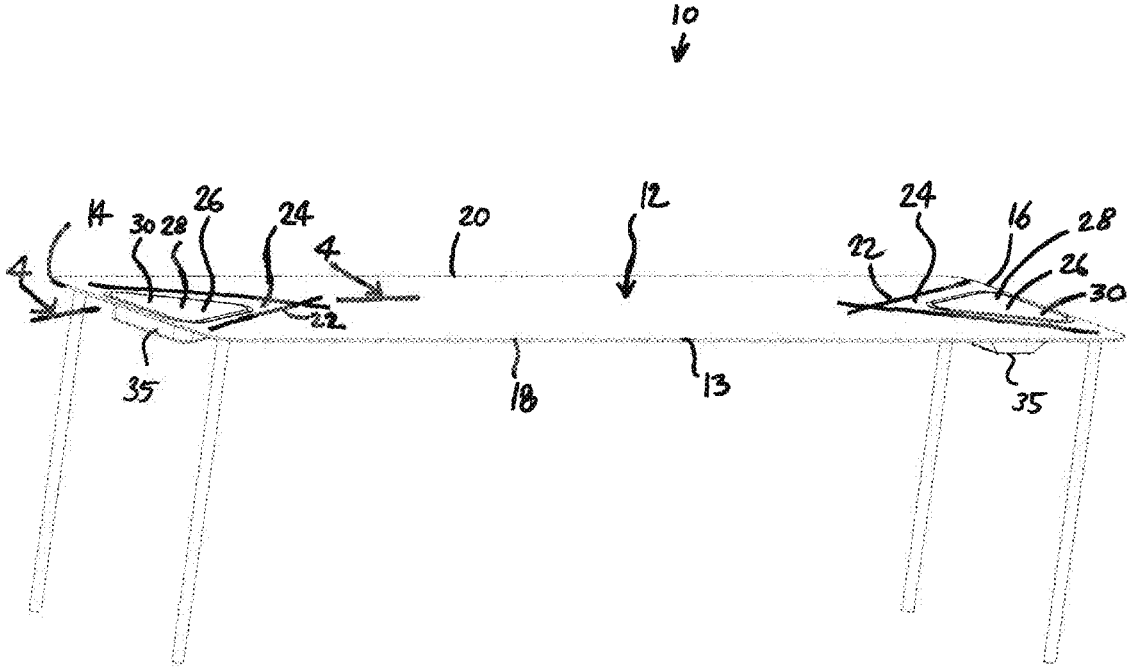
FIG. 1 is a perspective view of a beer pong table formed in accordance with the subject invention.

With reference to the Figures, a beer pong table 10 is depicted having an elongated top surface 12 facing upwardly. The top surface 12 can be of varying dimensions and configurations. Preferably, the top surface 12 is rectangular and is bounded by first and second ends 14, 16 and first and second side edges 18, 20. It is further preferred that the top surface 12 have a slender configuration with the distance between the first and second ends 14, 16 being greater than the distance between the first and second side edges 18, 20, e.g., at least two times greater (6.5'×2') and, more preferably at least four times greater (8'×2'). The top surface 12 is configured to support a plurality of beverage-containing cups or containers placed thereon.

Figure 2:
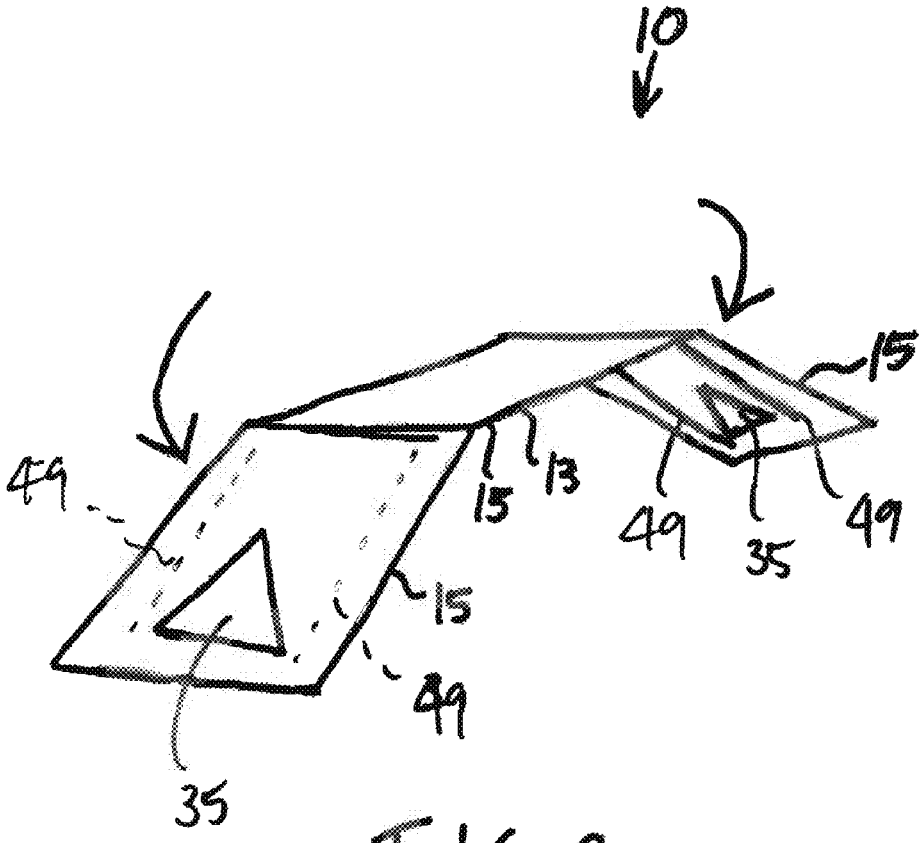
FIG. 2 shows a beer pong table with articulated sections formed in accordance with the subject invention.

The top surface 12 can be defined on a planar member 13, e.g., a table top, which can be formed from one or more components and/or one or more layers. Alternatively, the top surface 12 can be defined on top of an assembly (e.g., an entertainment system) and/or may be defined as an exposed surface of a non-table article or assembly. The top surface 12 may be defined on one or more structural elements which may be joined or separately arranged to define a continuous playing surface. As shown in FIG. 2, the planar member 13 may be formed by two or more articulated sections 15 which permit folding of the beer pong table 10. The articulated sections 15 may be joined by hinges to permit proper articulation.

As shown in FIG. 1, the table top surface 12 is provided with at least one, preferably two, playing areas 24. The playing areas 24 may be delineated by markings or indicia 22. With the game of beer pong, the playing areas 24 may be triangular in shape with each of the areas 24 being adjacent to one of the first and second ends 14, 16. The table top surface 12 may be adorned or decorated in various fashions to include different patterns, colors, insignia, and so forth.

Figure 3:
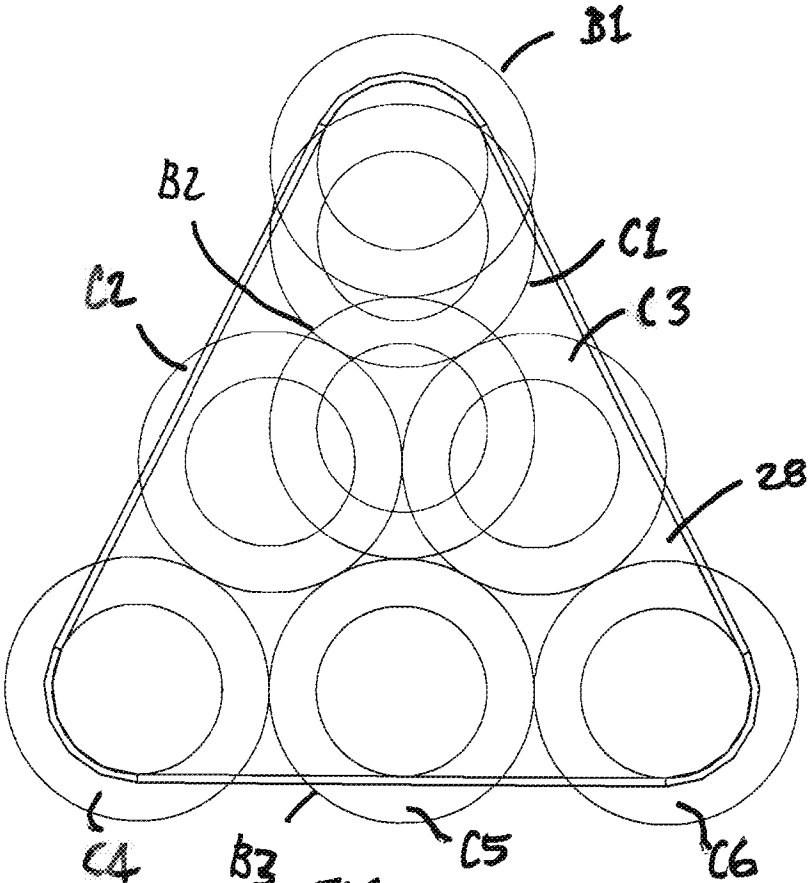
FIG. 3 is a schematic of cup arrangements for play with the subject invention.

The table top surface 12 is provided with at least one cooling area 26 for cooling any cups or containers placed thereon, as described below. Preferably, at least two of the cooling areas 26 are provided which at least partially coincide with the playing areas 24. The cooling areas 26 may cover varying extents of the table top surface 12 including areas greater than, equal to, or less than the playing areas 24. As shown in FIG. 1, preferably, a plurality of the cooling areas 26 may be provided each configured to cool an individual cup or container placed thereon. The cooling areas 26 are preferably arranged to accommodate a triangular pattern of ten cups (in a 4-3-2-1 pattern) or six cups (in a 3-2-1 pattern (C1-C6, FIG. 3)). Other triangular patterns are possible (e.g., a fifteen cup arrangement (5-4-3-2-1 pattern)), as well as, other geometric or irregular patterns. During play, cups may be re-arranged, such as from the 3-2-1 triangular pattern (C1-C6) to a straight line arrangement (B1-B3). Other arrangements are possible.

Figure 4:
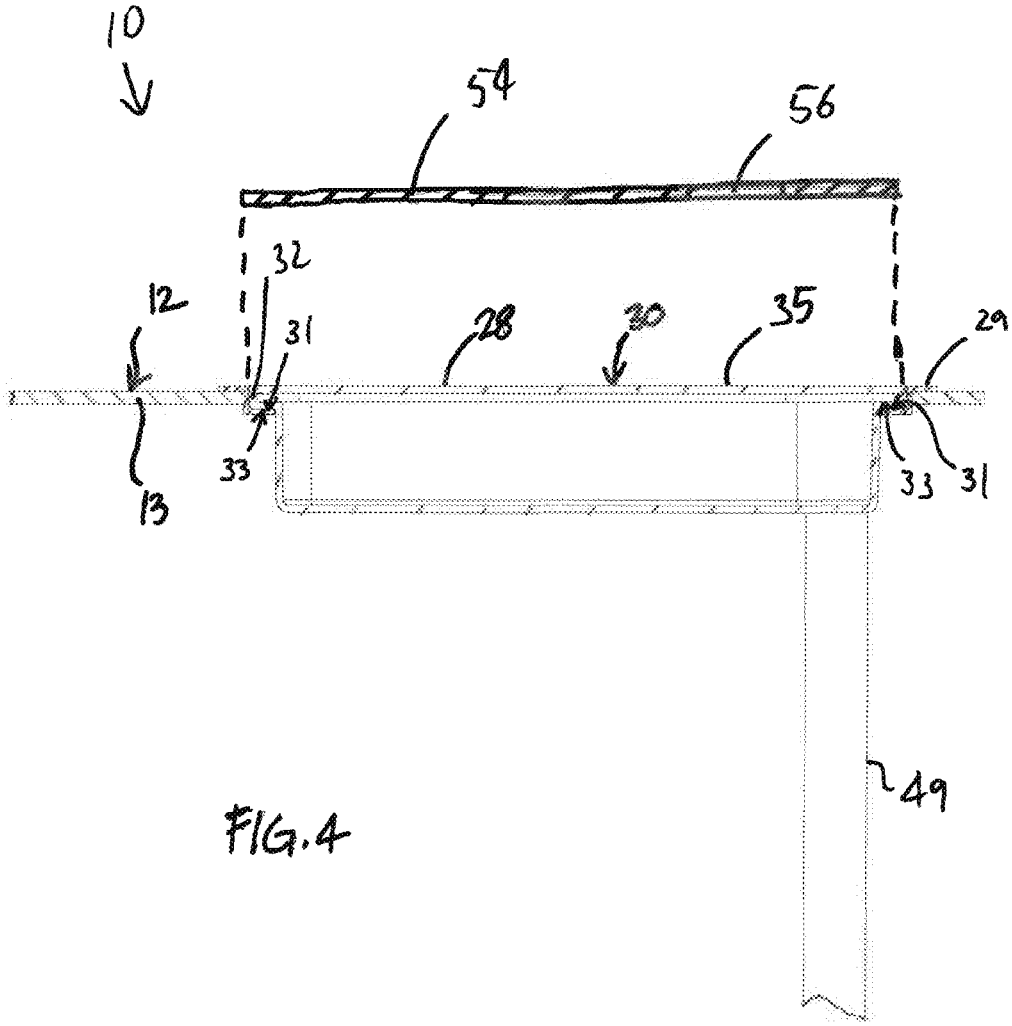
FIG. 4 is a partial cross-sectional view taken along line 4-4 of FIG. 1.

As will be appreciated by one skilled in the art, various cooling mechanisms may be provided to provide active and continuous cooling to the cooling areas 26. Preferably, at least one heat transfer member 28 is located at each of the cooling areas 26. The heat transfer member 28 may have an exposed face 30 disposed to be generally flush with the table top surface 12 (FIG. 1). Preferably, the heat transfer member 28 has a generally triangular shape. In this manner, a continuous, generally flat resting surface may be defined collectively by the top surface 12 and the exposed faces 30 to accept placement of cups or containers thereon. Preferably, the heat transfer members 28 are formed from a material with a relatively large coefficient of heat transfer, such as aluminum or copper. The heat transfer members 28 may be formed of other materials, such as a thermoplastic or other polymeric material. Other shapes and configurations are possible for the heat transfer members 28, such as being rectangular, circular (e.g., disc shaped), coil shaped, or other geometric (e.g., polygonal) or irregular shaped. In addition, the heat transfer members 28 may coincide with more than one cooling area 26, thus, permitting a plurality of cups or containers to be placed thereon. As best shown in FIG. 4, the heat transfer members 28 may be disposed in recesses 32 defined in the table top surface 12.

Figure 5:
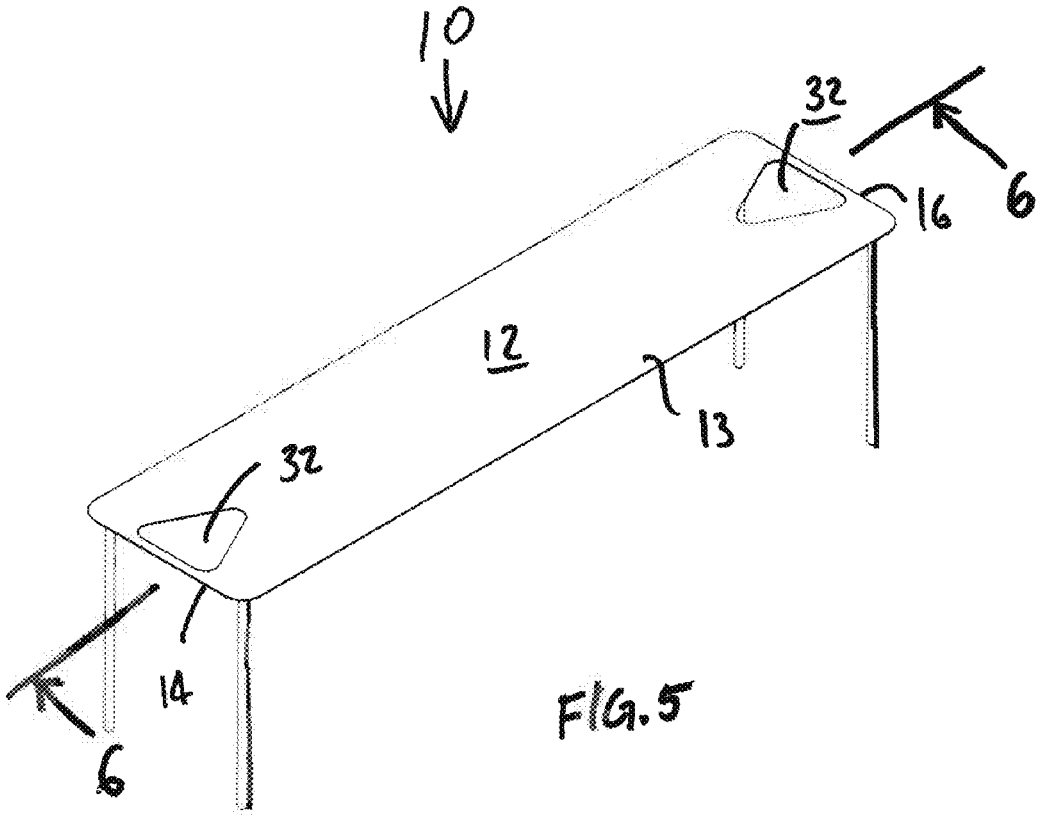
FIG. 5 is a perspective view of the beer pong table of the subject invention showing the recesses formed in accordance with the subject invention.
Figure 6:
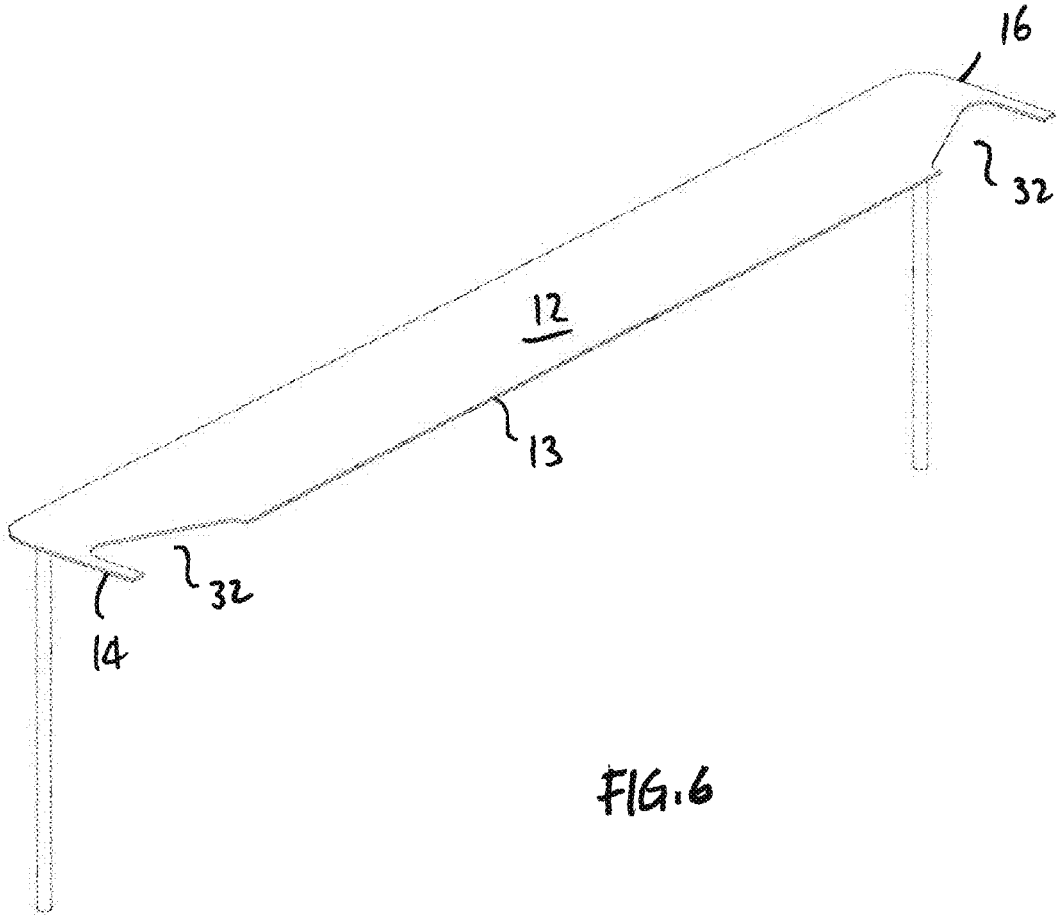
FIG. 6 is a cross-sectional view taken along line 6-6 of FIG. 5.

With reference to FIGS. 5 and 6, holes are formed to extend through the top surface 12 to at least partially extend through the planar member 13 to define the recesses 32. More preferably, the recesses 32 extend completely through the planar member 13 so as to define through holes through the planar member 13. It is preferred that two of the recesses 32 be provided, each adjacent to one of the ends 14, 16. Preferably, the recesses 32 are located 1-4 inches from the associated end 14, 16. It is further preferred that the recesses 32 be each triangular shaped. The recesses 32 may be formed during initial manufacturing. Alternatively, the recesses 32 may be formed in an existing beer pong table thereby retrofitting the table for cooling.

With reference to FIG. 4, cooling units 35 are disposed in the recesses 32. The cooling units 35 each include one or more of the heat transfer members 28 described above. Preferably, the heat transfer members 28 are each triangular and the exposed faces 30 define upper surfaces 30 of the cooling units 35.

The cooling units 35 may be removable from the associated recess 32 or fixed thereto. To be removable, the cooling units 35 may be configured to rest partially atop the top surface 12 and/or frictionally engage the associated recess 32. Preferably, the cooling units 35 rest atop the rims described below. The cooling units 35 may be fixed in the recesses 32 in any known manner, such as being fastened by nails, screws, adhesive and so forth to the planar member 13. Preferably, the cooling units 35 are removable. With the cooling units 35 being removable, the cooling units 35 may be exchanged (e.g., active for passive), removed for cleaning or preparation (e.g., placed into a freezer), and/or removed for repairs or replacement.

Figure 7:
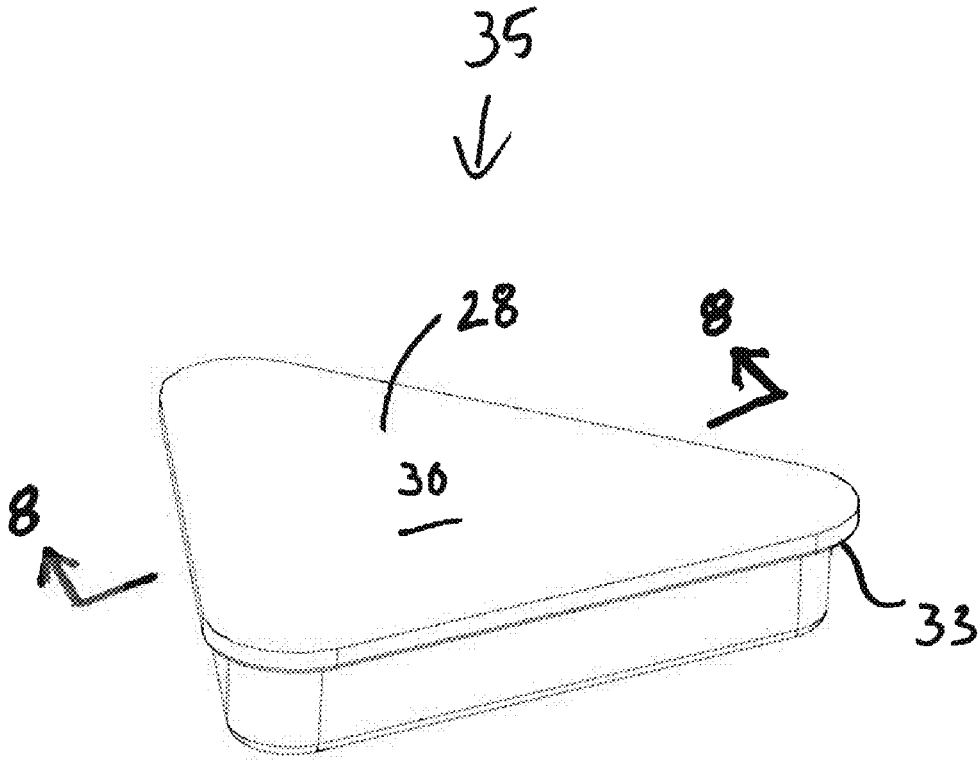
FIG. 7 is a perspective view of a passive cooling unit useable with the subject invention.
Figure 8:
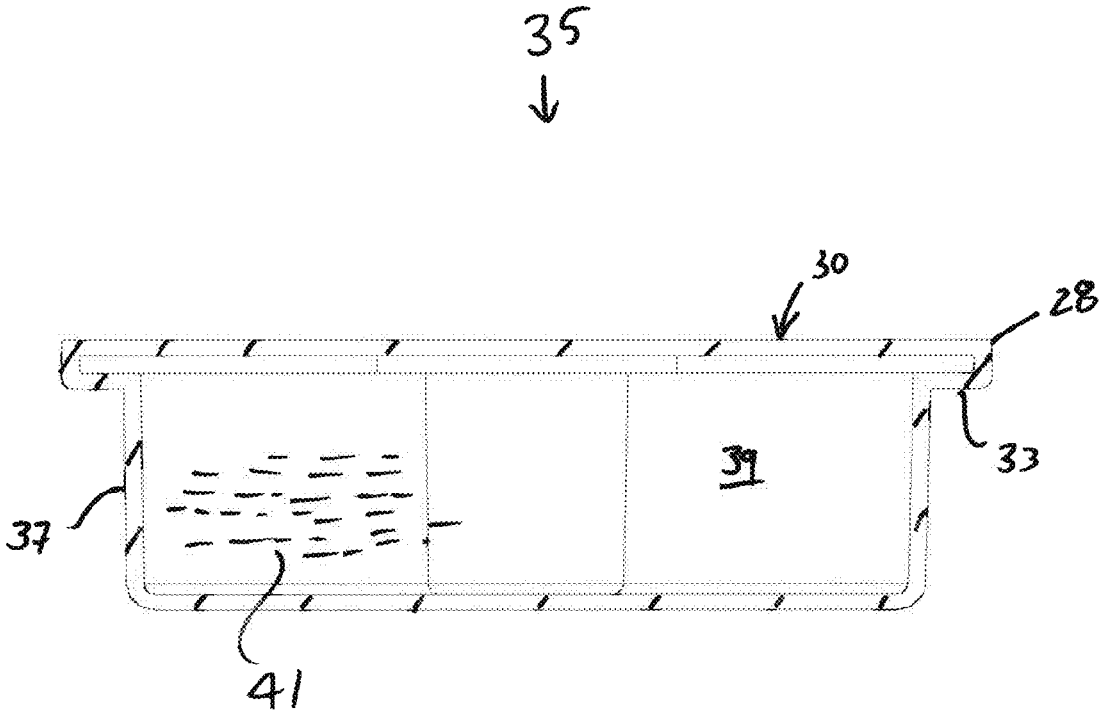
FIG. 8 is a cross-sectional view taken along line 8-8 of FIG. 7.
Figure 9:
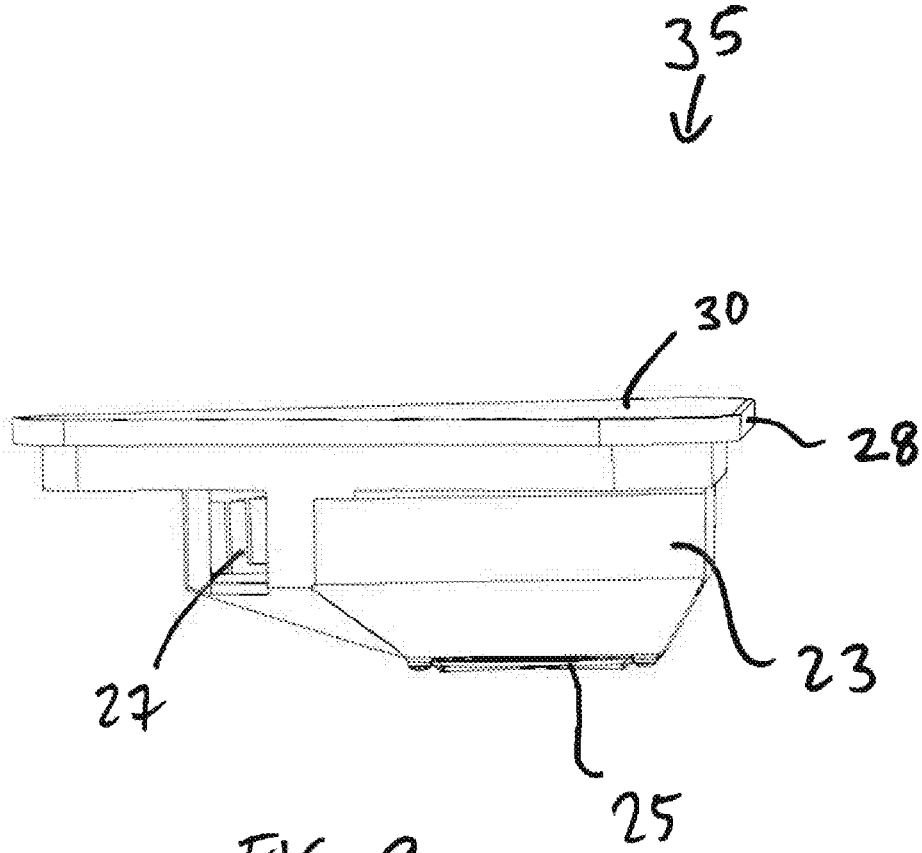
FIGS. 9-12 depict an active cooling unit useable with the subject invention.
Figure 10:
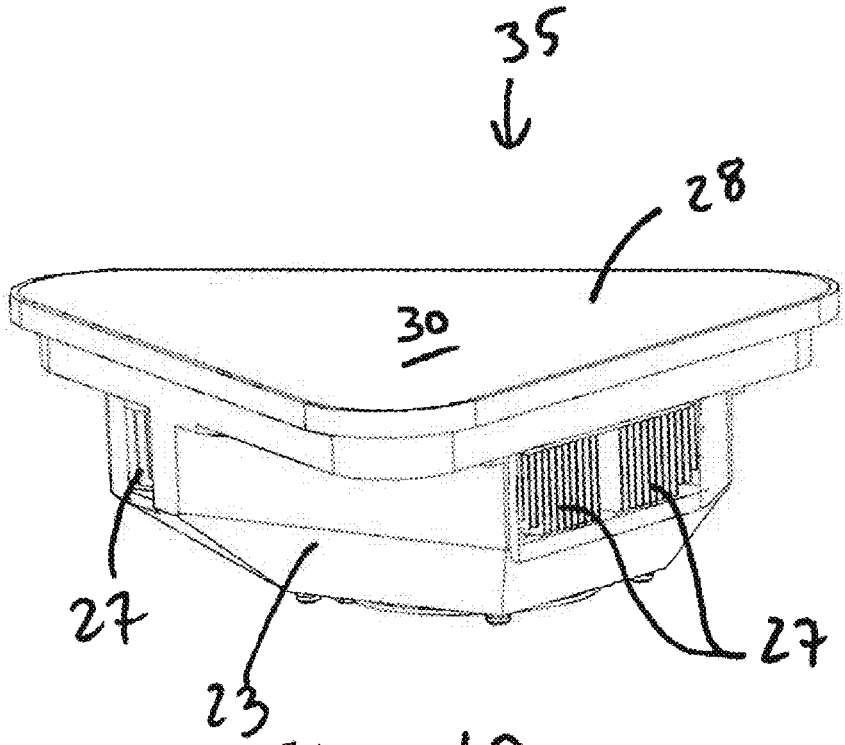
Figure 11:
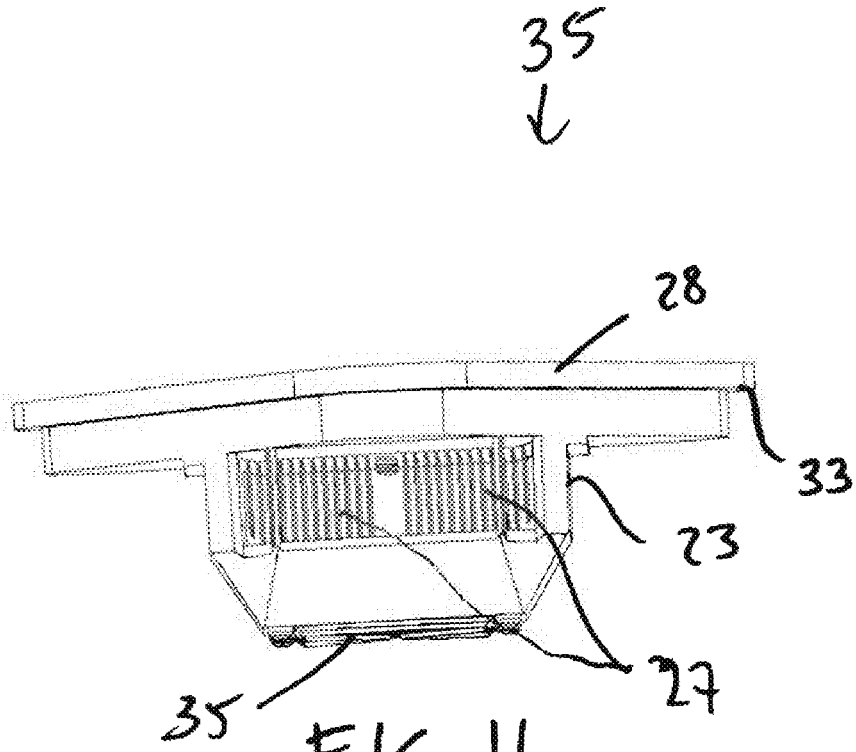
Figure 12:
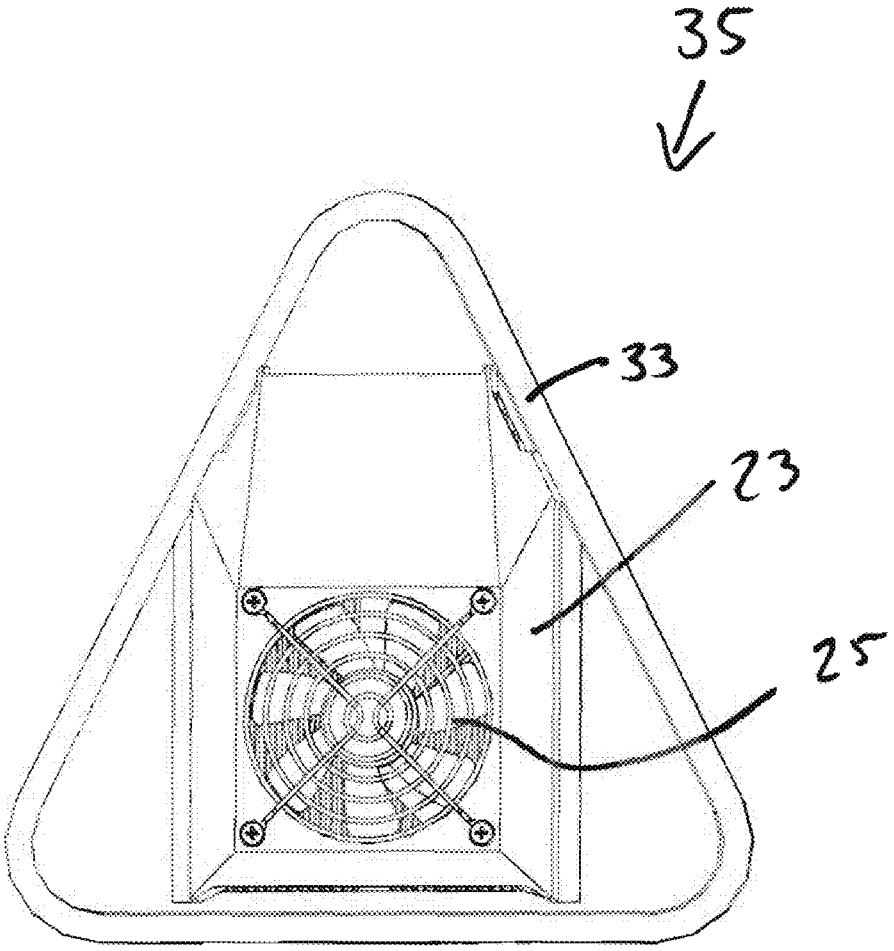

The cooling units 35 may be passive cooling elements (i.e., not powered cooling units). For example, as shown in FIGS. 7-8, the cooling units 35 may each include a frame 37 defining an interior 39 for housing, a medium 41, such as ice (e.g., compacted granular or solid ice), granular or solid carbon dioxide (dry ice), and/or a cooled member, preferably of relatively high thermal capacity, such as a chilled ceramic or frozen copper component. The cooling units 35 may be freezer pack type cooling units which provide cooling after being placed in a freezer for a period of time. Optionally, the cooling units 35 may be unitarily formed to be chilled with no medium 41 being provided therewith. Thus, with being removable, the cooling units 35 may be placed into a freezer and chilled for placement into the recesses 32.

It is preferred that the cooling units 35 be active cooling units (i.e., a powered cooling unit), more preferably, thermoelectric cooling assemblies 21. The thermoelectric cooling assemblies 21 may be sized to not extend beyond the side edges 18, 20 so that the beer pong table 10 may be folded without interference from the thermoelectric cooling assemblies 21. The thermoelectric cooling assemblies 21 may be formed as known in the art including using a Peltier-type junction for direct conductive cooling. By way of non-limiting example, FIGS. 9-12 depict a possible configuration of a thermoelectric cooling assembly. The thermoelectric cooling assembly 21 may include a housing 23 for containing the cooling mechanism. A fan 25 may be provided for each unit to enhance the cooling effect with one or more vents 27 being provided to allow proper air flow. The vents 27 are preferably located to be exposed during placement in the recesses 32.

Figure 13:
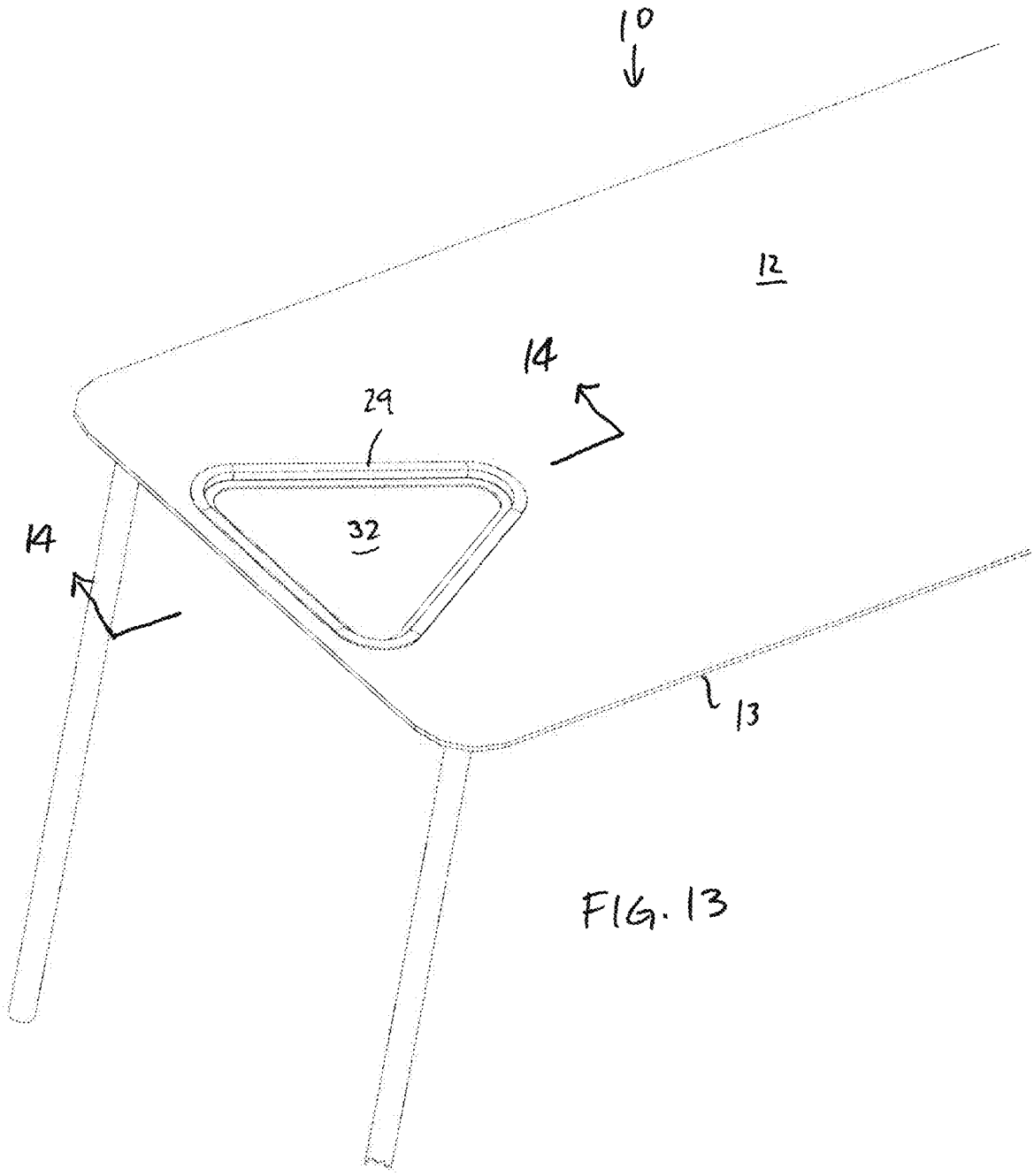
FIG. 13 is a partial perspective view showing a rim useable with the subject invention.
Figure 14:
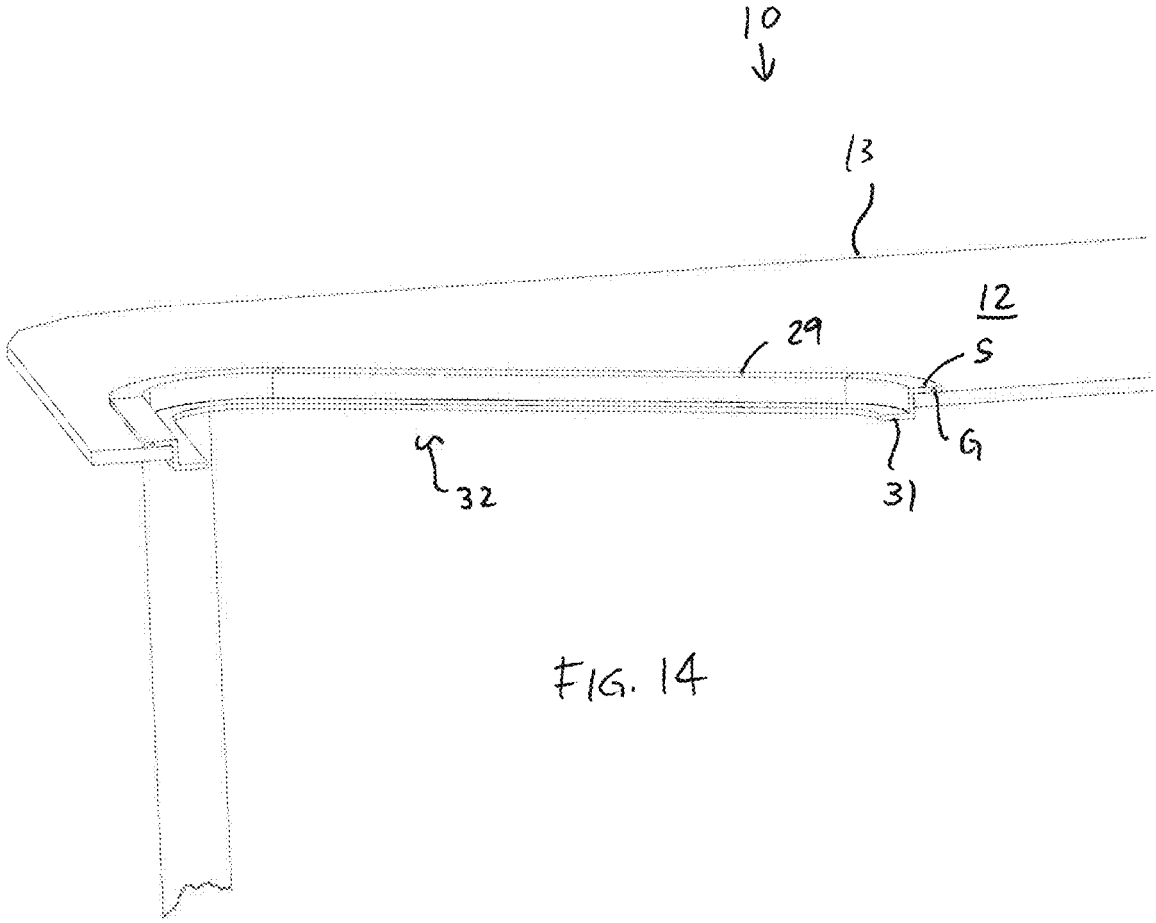
FIG. 14 is a cross-sectional view taken along line 14-14 of FIG. 13.

With reference to FIGS. 13-14, a rim 29 may be provided to at least partially perimetrically bound each of the recesses 32. The rim 29 may be fixed to the planar member 13 or, preferably, is sized with an upper shoulder S sized to lie atop the top surface 12. The rims 29 may be each sized to fit snugly into the associated recess 32 to provide holding force for the respective rim 29. To provide a sealing effect so as to minimize spillage under the rims 29 and into the recesses 32, one or more gaskets or sealing elements G may be provided. A ledge 31 extends inwardly from each of the rims 29. The ledge 31, as shown in FIG. 4, is each preferably shaped and configured to support the associated cooling unit 35. Preferably, the cooling units 35 may be formed with the heat transfer members 28 extending outwardly to define shoulders 33 configured to rest atop the ledges 31. The interengagement of the ledges 31 and the shoulders 33 provides support for the cooling units 35.

Figure 15:
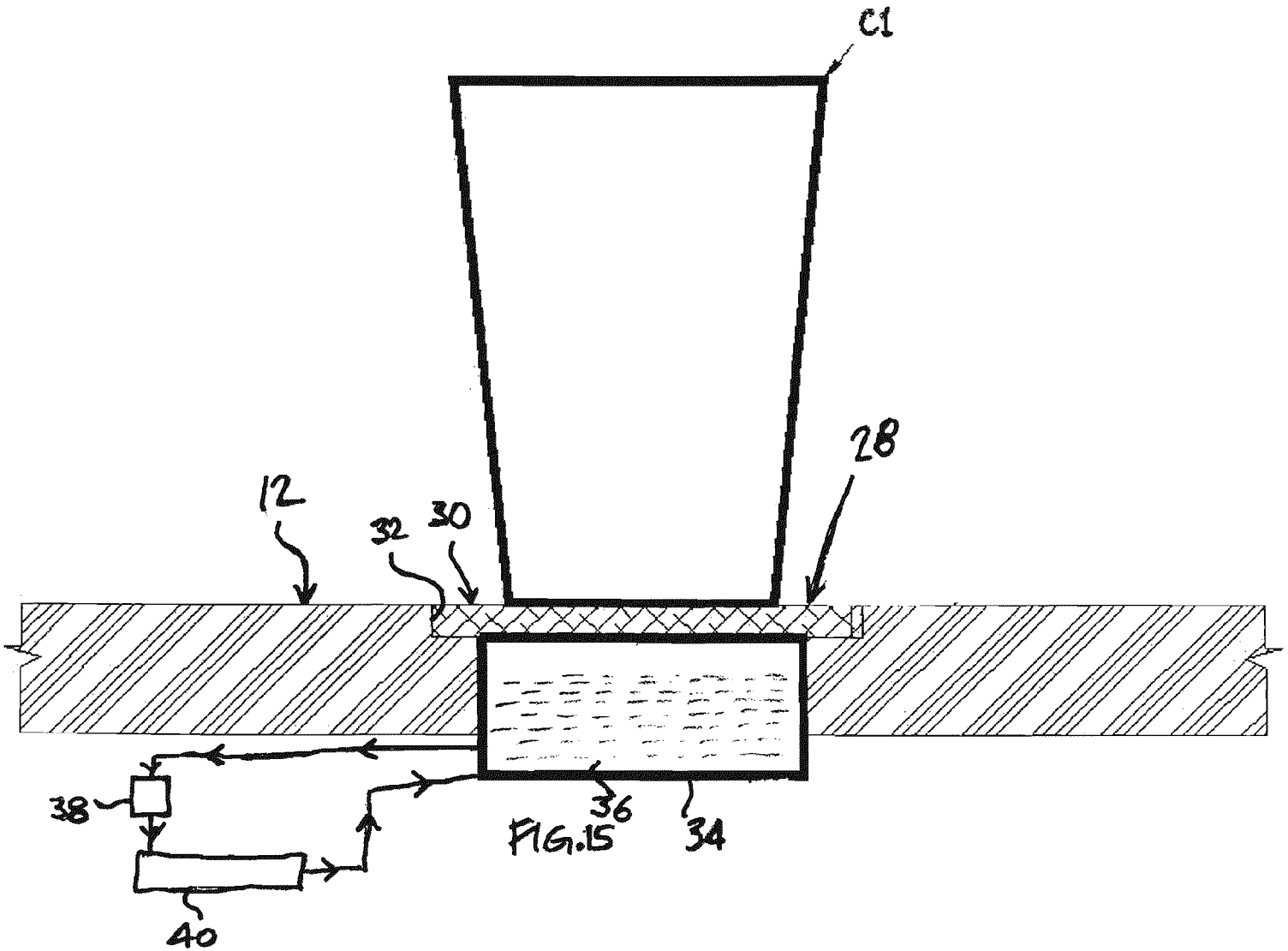
FIGS. 15-18 are schematics of cooling systems useable with the subject invention.

As alternatives to the thermoelectric cooling assemblies 21, other active cooling assemblies may be utilized, such as at least one cooling chamber 34 may be disposed adjacent to each of the heat transfer members 28 for providing cooling thereto. A cooled medium 36 (fluid (liquid or gas)) may be circulated through the cooling chamber 34 to maintain a predetermined level of cooling. The medium 36 may be water (alone or with a refrigerant) or air. As shown schematically in FIG. 15, the medium 36 may be circulated by a pump or compressor 38 and cooled by a cooling mechanism 40. Known equipment may be used to provide cooling to the medium 36 and/or for causing the medium 36 to be circulated. For example, the cooling mechanism 40 may be a refrigeration unit, heat exchanger (e.g., fan cooled; secondary-loop cooled), evaporator, expansion chamber (cooling through expansion of gas), vapor compression, and/or cooling modules (e.g., Peltier cooling modules). Preferably, the medium 36 is circulated in a closed loop to be continuously cooled to extract heat from the heat transfer members 28 thereby causing cooling of the heat transfer members 28, with the medium 36 being cooled as required.

Figure 16:
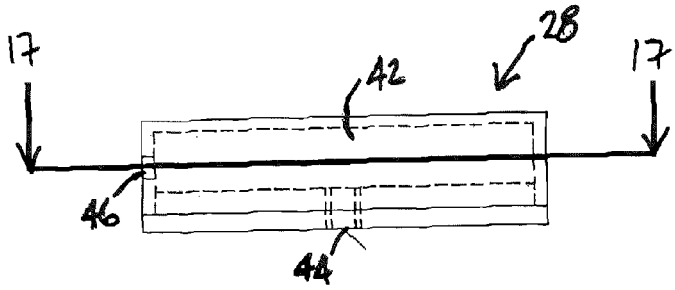
Figure 17:
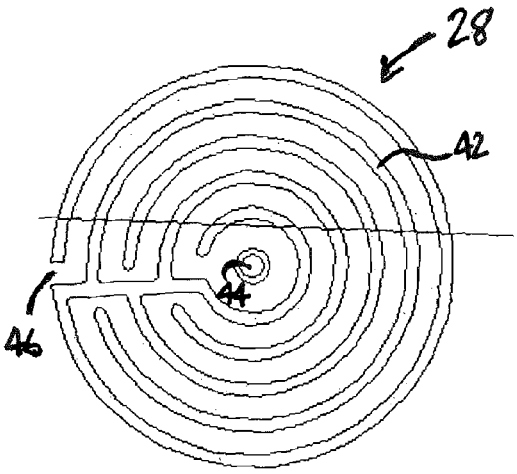
Figure 18:
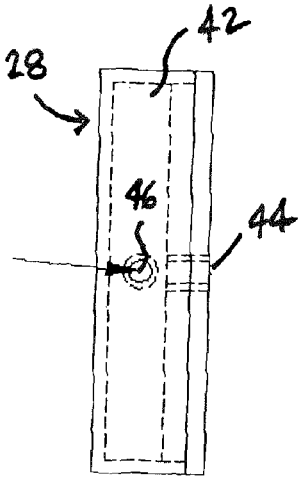

As an alternative to providing the cooling chambers 34, the heat transfer members 28 may be provided with one or more internal channels 42 formed therein through which the medium 36 may be circulated and discharged. As shown in FIGS. 16-18, an inlet port 44 may be defined on the heat transfer member 28, e.g., centrally, which is in communication with the internal channel 42. Preferably, the internal channel 42 defines a circuitous flow path from the inlet port 44 to provide maximum cooling to the exposed face 30 of the heat transfer member 28. A discharge port 46 is provided to permit the cooling medium 36 to be returned to the cooling mechanism 40 and circulated again through the heat transfer members 28.

During use, cups or containers are arranged in the playing areas 24 as desired, e.g., in a triangular fashion. The arrangement of the cups or containers should coincide at least in part with the cooling areas 26. During play, heat is caused to be taken away from the cooling areas by the cooling units 35, resulting in corresponding cooling of the cups or containers.

The cooling systems described herein may require electrical power for operation. The power may be provided in any conventional fashion, including via standard plug or battery source. In addition, power may be obtained from other electrical sources, e.g., solar cells. Controls may be provided on the cooling system for controlling the level of cooling.

The beer pong table 10 may be provided as a free-standing table with legs 49. As shown in FIG. 2, the legs 49 may be foldable. The cooling system may be incorporated into the table 10, such as with the pump 38 and/or the cooling mechanism 40 being provided therewith (e.g., below the table top surface 12). Alternatively, one or more components for the cooling system may be separately provided.

Figure 19:
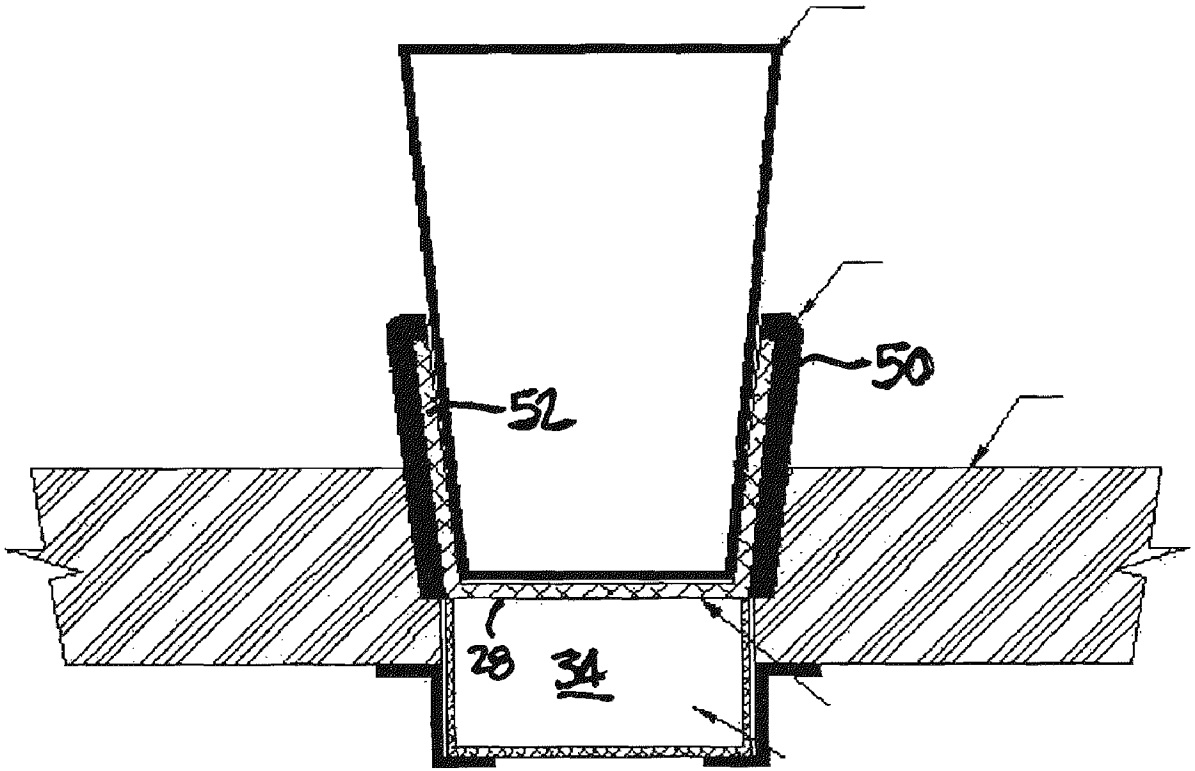
FIG. 19 is a schematic of sleeves usable with the subject invention.

To provide insulation, one or more insulation sleeves 50 may be disposed at the cooling areas 26 formed to nestingly receive a cup or container, as shown in FIG. 19. The insulation sleeves 50 may be mounted atop the heat transfer members 28 or partially recessed therein. In addition, one or more heat transfer side walls 52 may be provided to engage all or a portion of a cup or container side wall to provide an additional cooling effect. The heat transfer side wall 52 may be formed in the same manner, with possibly the same features, as the heat transfer member 28.

With reference to FIG. 4, a layer of insulation 54 may be provided to cover all or a portion of each of the heat transfer members 28. The layer of insulation 54 may be continuous or formed with one or more cut-outs 56 to accommodate a cup. The layer of insulation may be of any known type, but preferably is of a durable construction and water-resistant.

What is claimed is:

1. A beer pong table comprising:

an elongated, planar member having a top surface, wherein a hole extends through said top surface and at least partially through said planar member so as to define a first recess in said planar member; and, cooling means disposed in said first recess, wherein said cooling means includes an upper surface, said upper surface being generally flat throughout for simultaneously supporting a plurality of cups or containers and being generally coextensive with said top surface of said planar member with said cooling means being disposed in said first recess such that said upper surface and said top surface collectively define a generally flat surface.

2. The beer pong table of claim 1, wherein said upper surface being triangular shaped.

3. The beer pong table of claim 1, wherein said cooling means is powered by electricity.

4. The beer pong table of claim 3, wherein said cooling means is solar powered.

5. The beer pong table of claim 1, wherein said first recess is triangular shaped.

6. The beer pong table of claim 1, wherein said hole extends completely through said planar member.

7. The beer pong table of claim 1, wherein a rim at least partially perimetrically bounds said first recess.

8. The beer pong table of claim 7, wherein said rim includes an inwardly extending ledge.

9. The beer pong table of claim 8, wherein said cooling means is supported by said ledge.

10. The beer pong table of claim 1, wherein said cooling means is removable from said first recess.

11. The beer pong table of claim 10, wherein said cooling means includes a frame housing a cooling medium.

12. The beer pong table of claim 11, wherein said cooling medium includes a fluid.

13. The beer pong table of claim 11, wherein said cooling medium includes a solid.

14. The beer pong table of claim 1, wherein said cooling means is fixed in said first recess.

15. The beer pong table of claim 1, wherein said cooling means includes a thermoelectric cooling assembly.

16. The beer pong table of claim 1, wherein a second hole, spaced from said first-mentioned hole, extends at least partially through said planar member so as to define a second recess in said planar member.

17. The beer pong table of claim 16, further comprising a second cooling means disposed in said second recess.

18. The beer pong table of claim 17, wherein said planar member includes two spaced-apart side edges and two spaced-apart ends extending between said side edges, said side edges being longer than said ends, said side edges and said ends bounding said top surface, and wherein said first-mentioned cooling means is adjacent to a first said end of said planar member, and said second cooling means is adjacent to a second said end of said planar member.

19. The beer pong table of claim 1, wherein said cooling means includes a cooling chamber with a cooled medium being circulated therethrough.

* * * * *